United States Patent [19]

Nakamura et al.

[11] Patent Number: 4,858,765

[45] Date of Patent: Aug. 22, 1989

[54] PORTABLE HOLDER FOR STICK-TYPE COSMETIC CASE

[75] Inventors: Toshiko Nakamura; Tomio Tahara, both of Tokyo, Japan

[73] Assignee: Kamaya Kagaku Kogyo Co., Ltd., Taito, Japan

[21] Appl. No.: 200,622

[22] Filed: May 31, 1988

[30] Foreign Application Priority Data

Jan. 25, 1988 [JP] Japan ..... 63-7781[U]

[51] Int. Cl.[4] ..... A45G 11/00

[52] U.S. Cl. ..... 206/581; 132/315; 132/316; 132/318; 132/294; 132/297

[58] Field of Search ..... 206/581, 563, 562; 132/315, 293, 318, 316, 294, 297

[56] References Cited

U.S. PATENT DOCUMENTS

| | | | |
|---|---|---|---|
| 2,294,656 | 9/1942 | Feib | 206/581 |
| 4,526,273 | 7/1985 | Tsuji et al. | 206/581 X |
| 4,562,923 | 1/1986 | Katada et al. | 206/581 X |
| 4,666,043 | 5/1987 | Tahara | 206/581 |

FOREIGN PATENT DOCUMENTS

| | | | |
|---|---|---|---|
| 58-18807 | 4/1983 | Japan | 206/581 |

*Primary Examiner*—William Price

*Attorney, Agent, or Firm*—Hoffmann & Baron

[57] ABSTRACT

There is disclosed a holder for a stick-type cosmetic case which has an end portion of which the transverse outer size is smaller than that of the other portion of the cosmetic case. The holder includes: a holder body; a cover member; and a slanting surface. The holder body includes bottom and a peripheral walls defining a hollow for receiving the cosmetic case. The peripheral wall includes front and rear portions. The cover member is pivotally connected to the rear portion of the peripheral wall so as to open and close the hollow. The slanting surface extends between the bottom wall and the rear portion of the peripheral wall. The slanting surface inclines in such a manner that its rear edge is positioned at a higher level than its front edge. The distance between the front edge of the slanting surface and the front portion of the peripheral wall is less than the length of the cosmetic case and not less than the length of the other portion of the cosmetic case. The distance between the rear edge of the slanting surface and the lower face of the cover member is less than the transverse outer size of the other portion of the cosmetic case when the cover member is in its closed position. The holder further includes an opening or openings for allowing the end portion of the cosmetic case to project outward from the outer face of the front portion when the cosmetic case is in the hollow.

9 Claims, 4 Drawing Sheets

PORTABLE HOLDER FOR STICK-TYPE COSMETIC CASE

BACKGROUND OF THE INVENTION

This invention relates to a holder for a stick-type cosmetic case such as a lipstick tube, mascara case and the like, the holder being suitable for carrying the stick-type cosmetic case or cases.

In general, lipstick and mascara are encased in similar stick-type cases of similar sizes. Therefore, when a number of these stick-type case-encased cosmetics are put individually in a pocketbook, it is difficult and troublesome to find a particular cosmetic among the others. In order to avoid that inconvenience, there may be used as a container for the stick-type cosmetic cases, a small plastic cosmetic bag such as disclosed in Japanese Utility Model Publication No. Sho 33-18547 or a small plastic box such as disclosed in Japanese Utility Model Preliminary Publication No. Sho 59-1318.

However, these conventional bag and box have the following problems: That is, the plastic cosmetic bag cannot hold the cosmetic cases in organized manner, and moreover, is not convenient to handle since it is flexible. The plastic box enables the lipstick tubes or cases to be arranged neatly, however, is not convenient to handle either since such a box serves not only as a container for lipstick tubes but also as a cap for the lipstick tubes. More specifically, almost the entire lipstick tube must be inserted into the box in order to put each of the tubes in the box, while the lipstick tube must be pulled out in order to take each of the tubes out of the box.

SUMMARY OF THE INVENTION

Accordingly, it is an object of the present invention to provide a cosmetic case holder which is easy to handle and convenient for carrying stick-type cosmetic case or cases.

Another object of the present invention is to provide a cosmetic case holder in which the stick-type cosmetic cases are contained in organized manner.

Still another object of the present invention is to provide a cosmetic case holder which is of a simple structure, and thus, is not costly in manufacturing.

With these and other objects in view, the present invention provides a portable holder for containing a stick-type cosmetic case which has an end portion of which the transverse outer size is smaller than that of the rest of the cosmetic case. The portable holder includes: a holder body; a cover member and a slanting surface. The holder body includes a bottom wall and a peripheral wall which is formed along the periphery of the upper face of the bottom wall. The bottom and peripheral walls define a hollow for receiving the stick-type cosmetic case in the holder body. The peripheral wall includes front and rear portions. The front portion of the peripheral wall has first engaging means. The cover member is pivotally connected to the rear portion of the peripheral wall so as to open and close the hollow of the holder body. The cover member has second engaging means resiliently and releasably engageable with the first engaging means of the holder body so that the cover member is releasably fastened to the front portion of the peripheral wall when the cover member is in its closed position. The slanting surface extends between the upper face of the bottom wall and the inner face of the rear portion of the peripheral wall. The slanting surface inclines to the upper face of the bottom wall so that the rear edge of the slanting surface is positioned at a higher level than the front edge thereof. The distance between the front edge of the slanting surface and the front portion of the peripheral wall is less than the length of the cosmetic case and not less than the length of that portion of the cosmetic case excluding the end portion. The distance between the rear edge of the slanting surface and the lower face of the cover member is less than the transverse outer size of the other portion of the cosmetic case when the cover member is in its closed position. The case holder also includes an opening or openings for allowing the end portion of the cosmetic case to project outward from the outer face of the front portion when the cosmetic case is received in the hollow of the holder body.

The cosmetic case is received in the holder in such a manner that the end portion of the case is inserted into the opening. That is, when the cosmetic case is put in the case holder, the end portion of the cosmetic case projects outward from the holder. In order to open the cover member and to take the cosmetic case out of the holder, the projecting end portion of the cosmetic case is pressed inward. As the case's end portion is pressed, the other end of the case is brought into contact with the slanting surface, and thereby the other end is moved upward under the guidance of the slanting surface. As a result, the other end of the case pushes the cover member upward, causing the cover member to be released from the holder body. As is mentioned above, such a case holder is easy to handle, and is also convenient for carrying the stick-type cosmetic case or cases since the cosmetic cases can be arranged in the holder in organized manner.

DETAILED DESCRIPTION OF THE PREFERRED EMBODIMENTS

Figure 1:
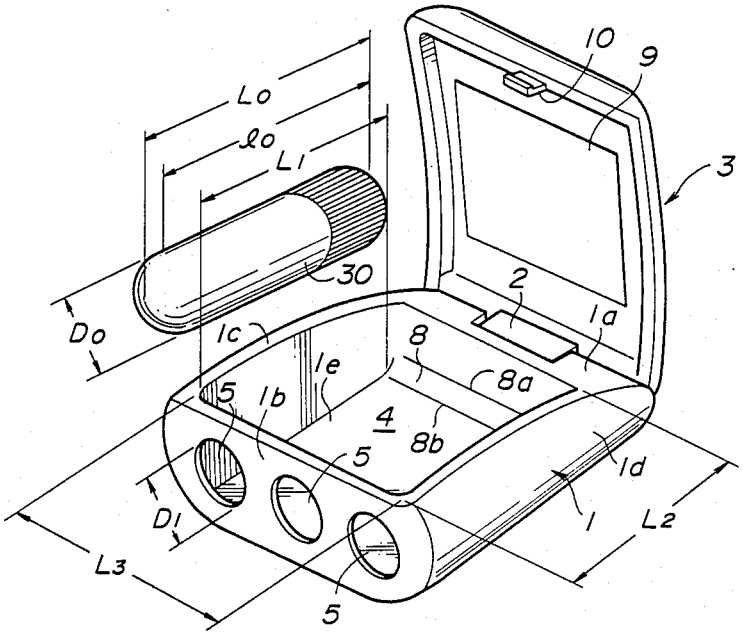
FIG. 1 is a perspective view of a portable cosmetic case holder according to the present invention, showing a cover member of the holder held in its opened position and a lipstick case together with the holder.

Referring now to the drawings, wherein like reference characters designate corresponding parts throughout several views, and descriptions of the corresponding parts are omitted after once given.

FIG. 1 illustrates a lipstick case holder according to the present invention and a lipstick-encasing stick-type case adapted to be received in the case holder. In this drawing, reference numeral 1 denotes a flat and generally rectangular holder body made of a synthetic resin.

Figure 3:
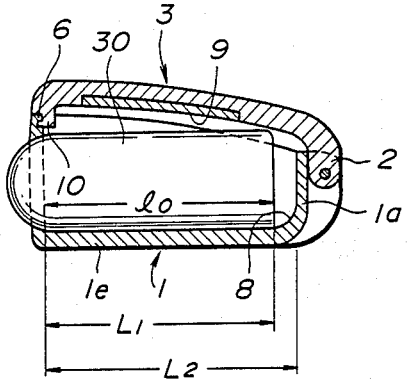
FIG. 3 is a view taken along the line III—III in FIG. 2.
Figure 4:
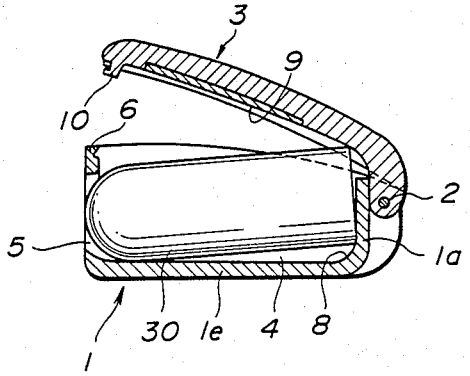
FIG. 4 is a similar view to FIG. 3, showing the lipstick case which is contained in the holder, pressed inward.

This holder body has a bottom wall 1*e* and peripheral walls, namely, front and rear walls 1*b* and 1*a* and a pair of side walls 1*c* and 1*d*. These walls 1*a* to 1*e* define at the center of the holder body 1, a hollow 4 for receiving cylindrical lipstick cases such as designated by reference numeral 30. A plate-like plastic cover member 3 of a similar rectangular configuration to the body 1 is pivotally connected to the rear wall 1*a* through a hinge 2 to open and close the hollow 4 of the holder body 1. As shown in FIGS. 3 and 4, the cover member 3 has second engaging means in the form of a hook portion 10 formed at the free front edge of the cover member 3 so that, when the cover member 3 is pivoted to its closed position, the hook portion 10 is releasably and resiliently engaged with first engaging means in the form of an engaging ridge 6 which is formed on the inner face of the front wall 1*b* of the holder body 1.

As best shown in FIG. 1, a slanting surface 8 is formed between the inner face of the rear wall 1*a* and the upper face of the bottom wall 1*e*. This slanting surface 8 is inclined to the upper face of the bottom wall 1*e* in such a manner that the rear edge 8*a* of the slanting surface 8 is positioned at a higher level than the front edge 8*b* thereof. The hollow 4 of the holder body 1 includes: a first section above the flat upper face of the bottom wall 1*e*; and a second section above the slanting surface 8. The distance between the front wall 1*b* and the front edge 8*b* of the slanting surface 8, namely, the longitudinal size $L_1$ of the first section of the hollow 4 is less than the length $L_0$ of the lipstick case 30 and not less than the length $l_0$ of that portion of the lipstick case 30 excluding its rounded end portion. The distance between the front and rear walls 1*b* and 1*a*, namely, the longitudinal inner size $L_2$ of the holder body 1, is approximately as large as the length $L_0$ of the lipstick case 30. Further more, the distance between the side walls 1*c* and 1*d*, namely, the transverse inner size $L_3$ of the holder body 1 is more than three times as large as the outer diameter $D_0$ of the lipstick case 30. The height of each of the side walls 1*c* and 1*d* is gradually reduced toward the rear wall 1*a* so that the upper surfaces of the respective side walls 1*c* and 1*d* are inclined to the bottom wall 1*e*.

As further shown in FIG. 1, the front wall lb has allowing means in the form of three circular apertures 5, formed therethrough, for receiving and retaining the rounded end portions of the lipstick cases 30. These three apertures 5 are disposed in a row at equal transverse intervals. The inner diameter $D_1$ of each aperture 5 is less than the outer diameter $D_0$ of the intermediate portion of the lipstick case 30 so that the lipstick cases 30, once received in the holder body 1, are prevented from falling out of the holder body 1 through the apertures 5. The lower face of the cover member 3 is slightly curved so that, when the cover member 3 is brought to its closed position, it is mated with the upper surfaces of the side walls 1*c* and 1*d*. When the cover member 3 is in its closed position, the distance between the lower face of the cover member 3 and the upper face of the bottom wall 1*e* is more than the diameter $D_0$ of the lipstick case 30 while the distance between the lower face of the cover member 3 and the slanting surface 8 is less than the diameter $D_0$ of the lipstick case 30. In addition, reference numeral 9 in FIGS. 1, 3 and 4 designates a mirror attached on the lower face of the cover member 3.

Figure 2:
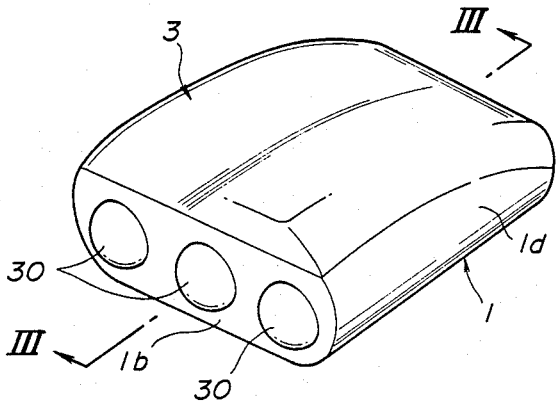
FIG. 2 is a perspective view of the holder in FIG. 1 with the cover member in its closed position and with the lipstick cases contained in it.

In order to put the lipstick cases 30 in the case holder described above, the cover member 3 is pivoted to its opened position as shown in FIG. 1, and then one of the lipstick cases 30 is laid in the hollow 4 with its rounded end portion inserted into one of the apertures 5. The rest of the cases 30 are laid in the hollow 4 in the same manner one after the other. Thereafter, the cover member 3 is pivoted to its closed position so that the hook portion 10 is resiliently engaged with the ridge 6. As a result, the cover member 3 is releasably fastened to the holder body 1, and, as shown in FIGS. 2 and 3, the lipstick cases 30 are settled in the case holder with their rounded end portions protruding outward from the holder through the apertures 5 and with the other portions of the cases 30 positioned within the first section of the hollow 4. More specifically, when the lipstick cases 30 are settled in the holder, the second section of the hollow 4 is, naturally, kept empty since the distance between the slanting surface 8 and the lower face of the cover member 3 is less than the diameters $D_0$ of the lipstick cases 30.

When it is necessary to take the lipstick cases 30 out of the holder, the protruding rounded end portion of any one of the lipstick cases 30 is pressed inward by the user's fingers. As the lipstick case 30 is pressed, the rear end of the lipstick case 30 is brought into the second section of the hollow 4 and thus, contacts the slanting surface 8. Then, the rear end is moved upward under the guidance of the slanting surface 8 as shown in FIG. 4. As a result, the rear end of the lipstick 30 abuts against the lower face of the cover member 3, thereby pushing the cover member 3 upward, causing the hook portion 10 to be disengaged from the ridge 6. After that, the cover member 3 is pivoted to its opened position, and a desired lipstick case or cases 30 are picked up from the hollow 4. While picking up the lipstick case 30, its rounded end portion should continue being pressed so that the lifted rear end of the lipstick case 30 facilitates the picking-up operation. In this case holder, since the rounded ends of the holder-encased lipstick cases 30 are visible from the outside, it is easily known by the users whether or not there are any lipstick cases missing.

Figure 5:
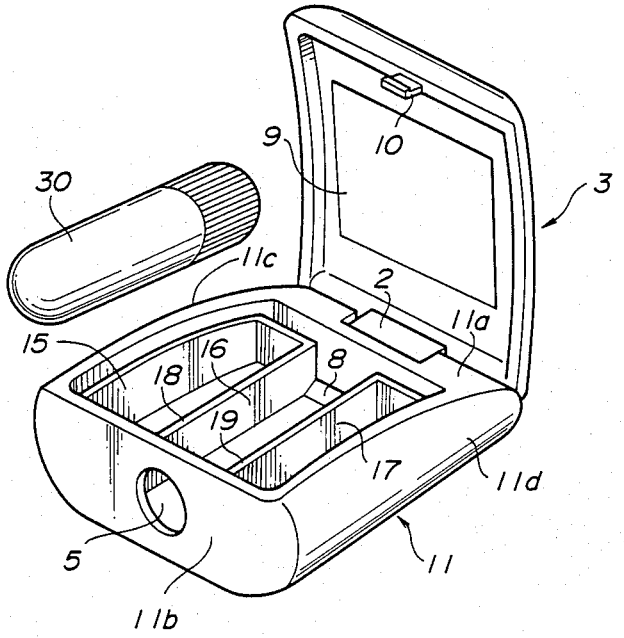
FIG. 5 is a perspective view of a modified form of the case holder in FIG. 1.

FIG. 5 illustrates a modified form of the case holder in FIG. 1, in which the hollow of the holder body 11 is divided into three transversely aligned chambers 15, 16 and 17 by inner partition walls 18 and 19 which extend substantially parallel to the side walls 11*c* and 11*d* of the body 1. The central chamber 16 which is defined between the partition walls 18 and 19 is prepared for receiving a lipstick case 30, while the other two side chambers 15 and 17 are prepared for containing powdery cosmetics such as face powder, rouge, eye shadow and the like. The front wall 11*b* of the holder body 1 has one aperture 5 in communication with the central chamber 16. That is, this modified form holder can be used as a so-called vanity case. However, it is not necessary for this vanity case to be provided with a specific push button for unfastening the cover member 3 from the body 11 since the unfastening operation is achieved by the pressing action of the lipstick case 30.

Figure 6:
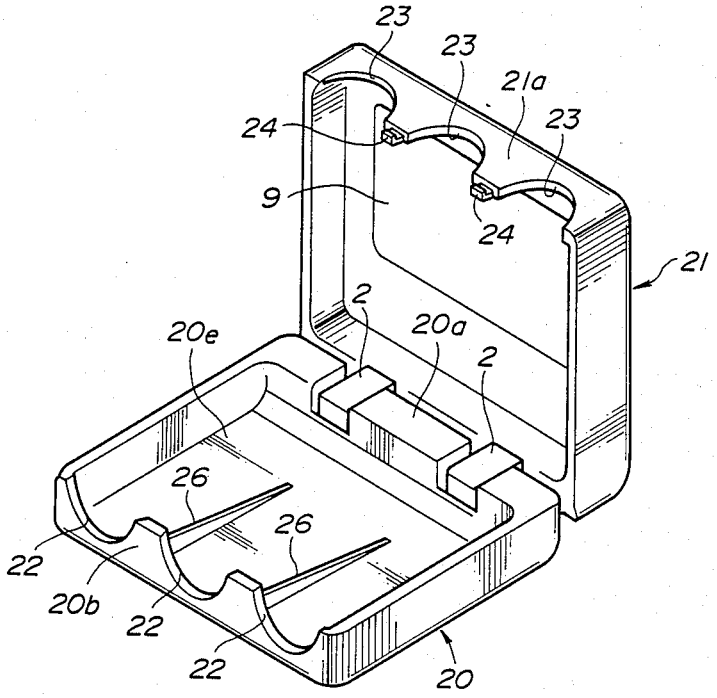
FIG. 6 is a perspective view of another embodiment according to the present invention.
Figure 7:
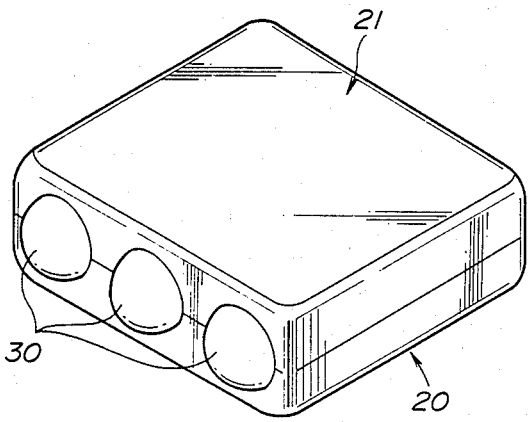
FIG. 7 is a perspective view of the holder in FIG. 6 with a cover member held in its closed position.

Another embodiment of the present invention is illustrated in FIGS. 6 and 7, in which the front wall 20*b* of a flat and rectangular holder body 20 has three semicircular notches 22 formed therein so as to open to the upper face of the front wall 20*b*. A cover member 21 is of a similar rectangular configuration to the holder body 20, and has a front wall 21*a* of which the lower face is adapted to be mated with the upper face of the holder body's front wall 20*b* when the cover member 21 is brought to its closed position. The front wall 21*a* of the cover member 21 also has three semicircular notches 23 opening to the lower face thereof. When the front wall 21*a* is mated with the front wall 20*b* of the holder body 20, the notches 23 coincide with the respective notches 22 of the holder body's front wall 20*b* to form three full circular apertures for receiving the rounded end portions of the lipstick cases 30. Two partition walls 26 and 26, each extending from the front wall 20*b* toward the rear wall 20*a*, are formed on the bottom wall 20*e* of the holder body 20 so as to prevent the transverse movement of each lipstick 30 put in this case holder. Reference numerals 24 and 24 in FIG. 6 denote a pair of hook portions which are formed on the front wall 21*a*of the cover member 21. These hook portions 24 are releasably and resiliently engageable respectively with a pair of ridges (not shown) formed on the inner face of the front wall 20*b* of the holder body 20. In putting the lipstick cases 30 in this case holder, the rounded end portions of the cases 30 are merely placed in the notches 22. In taking the cases 30 out of the holder, it is possible to pick up the cases 30 by lifting the rounded end portions of the cases 30 directly from the notches 22. Consequently, the putting-in and taking-out of the lipsticks 30 to and from this case holder are much easier than the case holder of the foregoing embodiment.

Although in the foregoing embodiments, only the lipstick cases 30 having the rounded end portions are received in the holder, it should be readily apparent that lipstick cases with truncated conical or similar end portions may also be put in the holders. Instead of the lipstick cases 30, mascara cases or other stick-type cosmetic cases may also be carried within the holder. Furthermore, in place of the circular apertures, polygonal or elliptic apertures may be employed according to the configurations of the end portions of the cosmetic cases.

What is claimed is:

1. A portable holder for containing a stick-type cosmetic case having an end portion and the other portion, the end portion being of a transverse outer size smaller than the transverse outer size of the other portion, the portable holder comprising:

a holder body including a bottom wall and a peripheral wall, the bottom wall having an upper face, the peripheral wall being formed along the periphery of the upper face of the bottom wall, the bottom and peripheral walls defining a hollow for receiving the stick-type cosmetic case in the holder body, the peripheral wall including front and rear portions, the front portion having first engaging means and outer and inner faces, the rear portion having an inner face confronting the inner face of the front portion;

a cover member, pivotally connected to the rear portion of the peripheral wall, for opening and closing the hollow of the holder body, the cover member having a lower face and second engaging means, the lower face confronting the bottom wall when the cover member is in its closed position, the second engaging means being resiliently and releasably engageable with the first engaging means of the holder body so that the cover member is releasably fastened to the front portion of the holder body when the cover member is in its closed position;

means for allowing the end portion of the cosmetic case to project outward from the outer face of the front portion when the cosmetic case is received in the hollow of the holder body; and a slanting surface extending between the upper face of the bottom wall and the inner face of the rear portion of the peripheral wall, the slanting surface having front and rear edges and inclining to the upper face of the bottom wall so that the rear edge is positioned at a higher level than the front edge, the distance between the front edge of the slanting surface and the front portion of the peripheral wall being less than the length of the cosmetic case and not less than the length of the other portion of the cosmetic case, the distance between the rear edge of the slanting surface and the lower face of the cover member being less than the transverse outer size of the other portion of the cosmetic case when the cover member is in its closed position.

2. A portable holder according to claim 1, wherein said means for allowing includes the front portion of the peripheral wall having an aperture formed therethrough, the aperture having a transverse inner size substantially equal to the transverse outer size of the end portion of the cosmetic case so as to receive and retain the end portion of the cosmetic case when the cosmetic case is received in the hollow.

3. A portable holder according to claim 2, wherein the holder body further includes a partition wall formed on the upper face of the bottom wall, the partition wall extending between the front and rear portions of the peripheral wall, the partition wall dividing the hollow into first and second chambers, the first chamber being in communication with the aperture so as to receive the cosmetic case, the second chamber being adapted to contain a powdery cosmetic.

4. A portable holder according to claim 1, wherein said means for allowing includes the front portion of the peripheral wall having a plurality of apertures formed therethrough, the apertures being peripherally arranged at intervals, each of the apertures having a transverse inner size substantially equal to the transverse outer size of the end portion of the cosmetic case so as to receive and retain the end portion of the cosmetic case when the cosmetic case is received in the hollow.

5. A portable holder according to claim 4, wherein the holder body further includes a partition wall formed on the upper face of the bottom wall, the partition wall extending from that portion of the peripheral wall between the adjoining apertures toward the rear portion of the peripheral wall so as to prevent the transverse movement of the cosmetic case when the cosmetic case is received in the hollow.

6. A portable holder according to claim 1, wherein said means for allowing includes the front portion of the peripheral wall having an upper face and a first notch, the first notch opening to the upper face of the front portion, wherein the cover member includes a front wall, said means for allowing further including the front wall having a lower face and a second notch, the lower face of the front wall being mated with the upper face of the front portion of the peripheral wall when the cover member is in its closed position, the second notch opening to the lower face of the front wall, the second notch coinciding with the first notch to form an aperture when the lower face of the front wall is mated with the upper face of the front portion, the aperture having a transverse inner size substantially equal to the transverse outer size of the end portion of the cosmetic case so as to receive and retain the end portion of the cosmetic case when the cosmetic case is received in the hollow.

7. A portable holder according to claim 1, wherein said means for allowing includes the front portion of the peripheral wall, the front portion defining an aperture, and wherein the holder body further includes a partition wall formed on the upper face of the bottom wall, the partition wall extending between the front and rear portions of the peripheral wall, the partition wall dividing the hollow into first and second chambers, the first chamber being in communication with the aperture so as to receive the cosmetic case, the second chamber being adapted to contain a powdery cosmetic.

8. A portable holder according to claim 1, wherein said means for allowing includes the front portion of the peripheral wall having an upper face and a plurality of first notches, the first notches opening to the upper face of the front portion, wherein the cover member includes a front wall, said means for allowing further including the front wall having a lower face and a plurality of second notches, the lower face of the front wall being mated with the upper face of the front portion of the peripheral wall when the cover member is in its closed position, the second notches opening to the lower face of the front wall, the second notches coinciding with the respective first notches to form a plurality of apertures when the lower face of the front wall is mated with the upper face of the front portion, each of the apertures having a transverse inner size substantially equal to the transverse outer size of the end portion of the cosmetic case so as to receive and retain the end portion of the cosmetic case when the cosmetic case is received in the hollow.

9. A portable holder according to claim 8, wherein the holder body further includes a partition wall formed on the upper face of the bottom wall, the partition wall extending from that portion of the peripheral wall between the adjoining notches toward the rear portion of the peripheral wall so as to prevent the transverse movement of the cosmetic case when the cosmetic case is received in the hollow.

* * * * *